US005469944A

United States Patent [19]

Wang

[11] Patent Number: 5,469,944

[45] Date of Patent: Nov. 28, 1995

[54] SWIVEL FOOT FOR TRAVEL BAGS

[76] Inventor: King-Sheng Wang, No. 569, Ching Kuo Road, Ta Chia Chien, Taichung Hsien, Taiwan

[21] Appl. No.: 280,662

[22] Filed: Jul. 27, 1994

[51] Int. Cl.[6] ..... A45C 3/00; A45C 13/00

[52] U.S. Cl. ..... 190/18 R; 190/18 A

[58] Field of Search ..... 190/18 R, 18 A, 190/39; 280/47.29, 37, 47.33

[56] References Cited

U.S. PATENT DOCUMENTS

| | | | |
|---|---|---|---|
| 420,759 | 2/1890 | Arnold | 190/37 |
| 995,942 | 6/1911 | Bain | 190/18 R |
| 1,081,670 | 12/1913 | James | 190/18 R X |
| 1,772,304 | 8/1930 | Bosque | 190/18 R |
| 2,096,768 | 10/1937 | Styll | 190/18 R |
| 2,662,619 | 12/1953 | Zweigbaum | 190/18 R X |
| 3,557,916 | 1/1971 | Stowell | 190/18 R X |
| 3,942,225 | 3/1976 | Kramer | 190/18 R X |
| 4,538,709 | 9/1985 | Williams et al. | 190/18 A |
| 5,004,091 | 4/1991 | Nath et al. | 190/18 R |
| 5,230,408 | 7/1993 | Sadow | 190/18 A |

FOREIGN PATENT DOCUMENTS

| | | | |
|---|---|---|---|
| 2331837 | 1/1975 | Germany | 190/18 A |
| 2022997 | 12/1979 | United Kingdom | 190/18 A |

*Primary Examiner*—Sue A. Weaver
*Attorney, Agent, or Firm*—Bacon & Thomas

[57] ABSTRACT

A swivel foot includes a mounting block fixedly fastened to a travel bag at the bottom, and a rectangular swivel block having one end pivotally fastened to the mounting block through a plug joint, wherein the swivel block has a raised portion alternatively engaged into either of two locating recesses on the mounting block for permitting the swivel block to be retained in an inward position in parallel with the mounting block or an outward position perpendicular to the mounting block.

4 Claims, 5 Drawing Sheets

SWIVEL FOOT FOR TRAVEL BAGS

BACKGROUND OF THE INVENTION

The present invention relates to a swivel foot for supporting a travel bag in a vertical position.

FIG. 1 shows a conventional travel bag which comprises two wheels bilaterally disposed at the bottom and a retractable handle at one side above the wheels. Therefore, the travel bag can be moved on the ground conveniently. The travel bag further comprises two feet at the bottom opposite to the wheels for supporting the travel bag in a vertical position. The feet are positioned on the ground so that the center of gravity of the travel bag is located at the center point of the bottom of the travel bag. However, when heavy things are carried inside the travel bag, the center of gravity of the travel bag becomes shifted, and the feet may be unable to stably support the travel bag in a vertical position.

SUMMARY OF THE INVENTION

The present invention has been accomplished to provide a swivel foot which eliminates the aforesaid problem.

According to one aspect of the present invention, the swivel foot is comprised of a mounting block fixed to a travel bag at the bottom, and a swivel block pivotally fastened to the mounting block at the bottom, wherein the swivel block can be turned within a ninety degree angle relative to the mounting block according to the loading of the travel bag.

According to another aspect of the present invention, the mounting block has a plug hole, the swivel block has a hollow, flanged, split plug tube raised from the top at one end and rotatably fitted into the plug hole on the mounting block. Therefore, the swivel block can be turned relatively to the mounting block.

According to still another aspect of the present invention, a headed bolt is provided and fitted into the hollow, flanged, split plug tube to secure the plug tube to the mounting block.

According to still another aspect of the present invention, the mounting block has an arcuate locating groove spaced around the plug hole through a ninety degree angle, the swivel block has a locating strip inserted into the locating groove on the mounting block to limit the rotary movement of the swivel block within a ninety degree angle relative to the mounting block.

According to still another aspect of the present invention, the mounting block has two locating recesses at the bottom and, the swivel block has a raised portion alternatively engaged into either locating recess to hold the swivel block in parallel with or perpendicular to the mounting block.

According to still another aspect of the present invention, the swivel block comprises a chamber, having two elongated ribs at two opposite sides and an upright stub tube in the center, and a cover covered on the chamber and having a downward pin fitted into the upright stub tube and two opposite grooves respectively engaged with the elongated ribs. The design of the chamber reduces the consumption of the material for making the swivel block.

DETAILED DESCRIPTION OF THE PREFERRED EMBODIMENT

Figure 1:
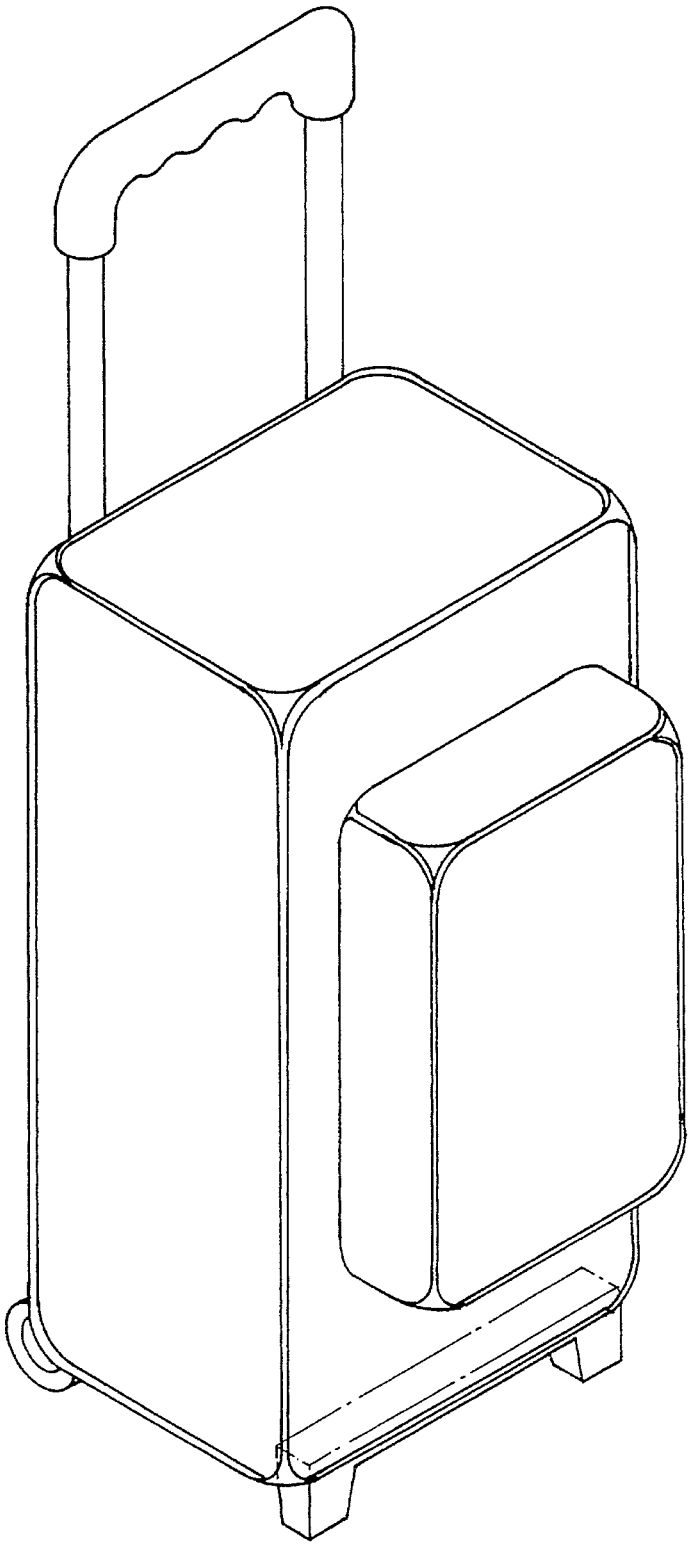
Fig 1 PRIOR ART
FIG. 1 shows a conventional travel bag.
Figure 2:
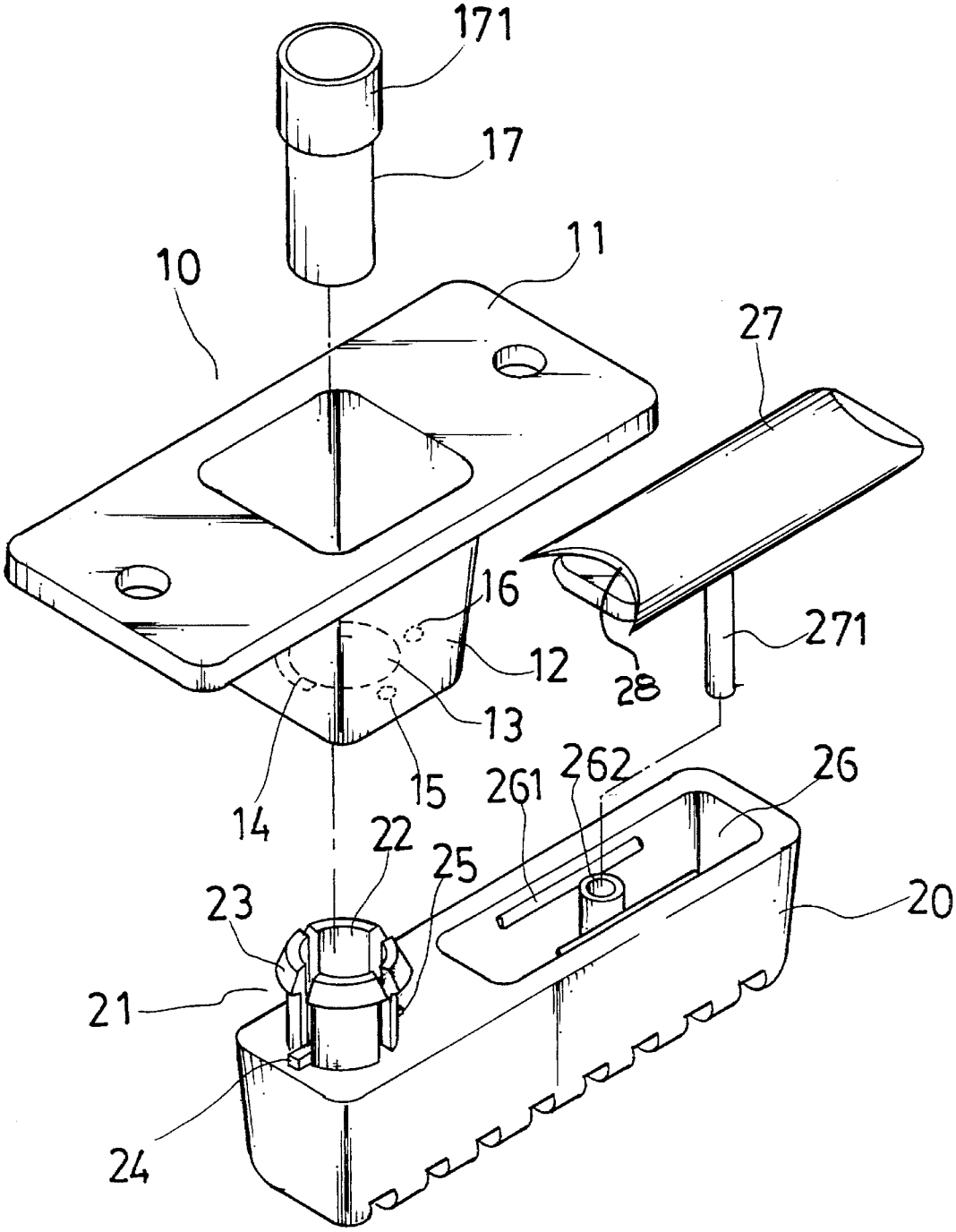
FIG. 2 is an exploded perspective view of a swivel foot according to the present invention.
Figure 3:
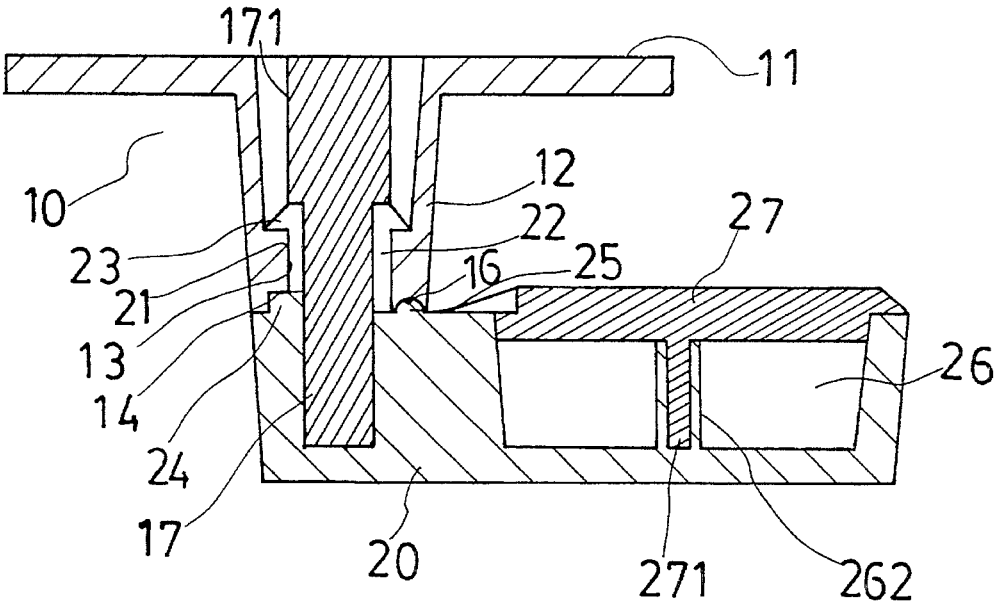
FIG. 3 is an assembly view in section of the swivel foot shown in FIG. 2.
Figure 4:
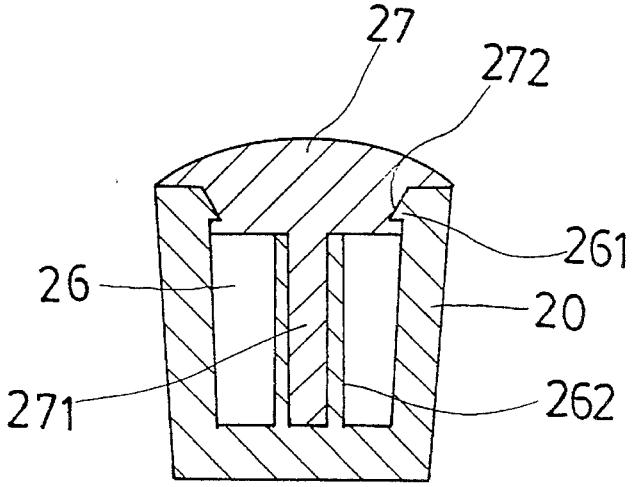
FIG. 4 is a cross-section of the swivel block shown in FIG. 3, showing the cover fastened to the chamber.

Referring to FIGS. 2, 3, 4 and 7, a swivel foot for a travel bag in accordance with the present invention is generally comprised of a mounting block 10 and a swivel block 20. The mounting block 10 comprises two outward mounting flanges 11 bilaterally disposed at the top and on the same elevation for fastening a travel bag, and a downward receptacle 12 in the middle. The receptacle 12 is made hollow in order to save material, and has a circular plug hole 13 in the center, an arcuate locating groove 14 spaced around the circular plug hole 13 at a different elevation and extending through a ninety degree arcuate angle, a first locating recess 15 and a second locating recess 16 spaced around the circular plug hole 13 at ninety degree angles opposite to the locating slot 14. The swivel block 20 is of substantially rectangular shape having an upright plug tube 21 and a chamber 26 spaced at the top. The bottom of the swivel block 20 is corrugated so that it does not slip on the ground. The plug tube 21 is of a hollow, split configuration and comprised of four symmetrical sections 22, each having a downward sloping flange 23 around the top. A locating strip 24 and a raised portion 25 are bilaterally made on the plug tube 21 at the bottom. Two elongated horizontal ribs 261 extend inwardly from two opposite side walls of the chamber 26. An upright stub tube 262 is disposed inside the chamber 26 in the center. There is provided a cover 27 for covering the chamber 26. The cover 27 has a downward bottom pin 271 fitted into the upright stub tube 262 of the swivel block 20, and two opposite grooves 272 respectively engaged with the ribs 261 (see FIG. 4). The periphery of the cover 27 is provided with a recessed portion 28 adjacent to receptacle 12 for permitting swivel block 20 to be turned relative to mounting block 10. As the plug tube 21 of the swivel block 20 is inserted into the circular plug hole 13 on the receptacle 12 of the mounting block 10, a headed bolt 17 is fitted into the plug tube 21 permitting the downward sloping flange 23 of the plug tube 21 to be retained between the head 171 of the headed bolt 17 and the inside bottom wall of the receptacle 12. When assembled, the locating strip 24 is inserted into the arcuate locating groove 14, and the raised portion 25 is engaged in either one of locating recesses 15 and 16.

Figure 5:
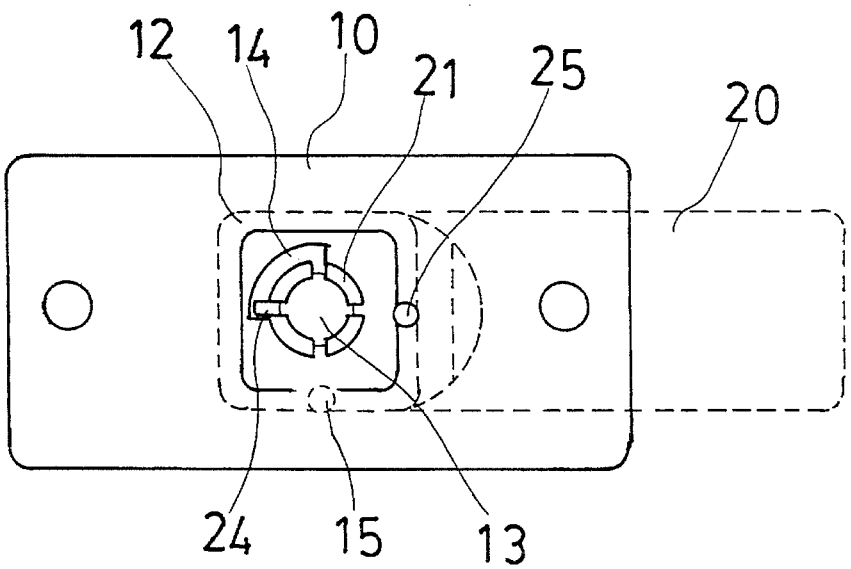
FIG. 5 is a top plain view of the swivel foot shown in FIG. 2, showing the swivel block turned to the inward position in parallel with the mounting block.

Referring to FIG. 5, when few things are carried in the travel bag or the center of gravity of the travel bag is disposed in the center, the swivel block 20 can be turned in the counter-clockwise direction to an inward position in parallel with the mounting block 10. When the swivel block 20 and the mounting block 10 are disposed in parallel, the raised portion 25 engages the second locating recess 16 to hold the swivel block 20 in the inward position.

Figure 6:
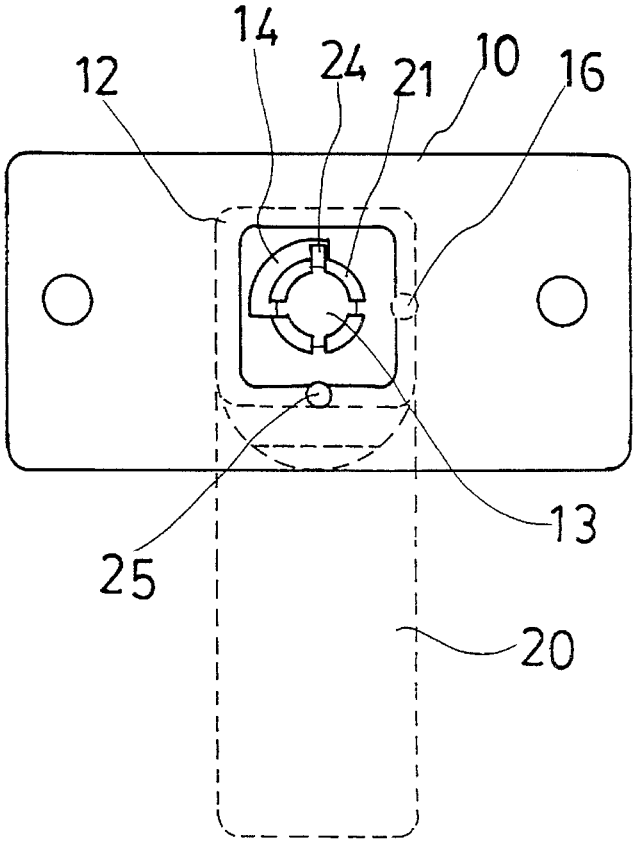
FIG. 6 is similar to FIG. 5 but showing the swivel block turned to the outward position perpendicular to the mounting block.

Referring to FIG. 6, when the travel bag becomes heavier on one side, the swivel block 20 is turned to an outward position perpendicular to the mounting block 10. When the swivel block 20 is disposed perpendicular to the mounting block 10, the raised portion 25 engages the first locating recess 15 to hold the swivel block 20 in the outward position.

Figure 7:
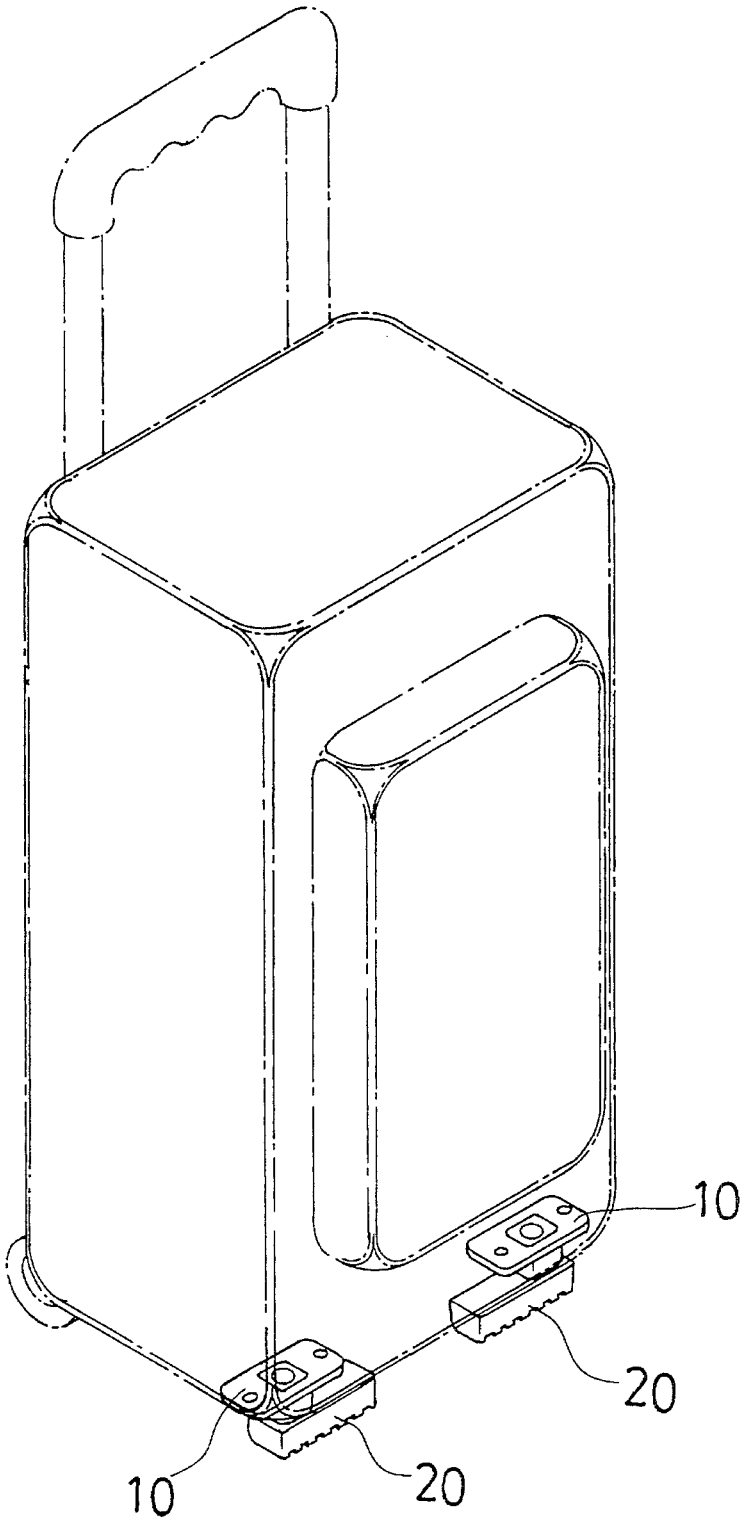
FIG. 7 is a perspective view showing the present invention installed in a travel bag.

Referring to FIG. 7, when two swivel feet of the present invention are symmetrically mounted on a travel bag at the bottom, the swivel feet can be adjusted according to the loading of the travel bag so that the travel bag can be stably supported on the ground in the vertical position.

I claim:

1. A swivel foot for a travel bag comprising:

a) a mounting block for attachment to the bottom of a travel bag, the mounting block including means for attachment to the travel bag, a downwardly extending receptacle, a circular plug hole formed at an extended end of the receptacle, an arcuate locating groove formed in the end of the receptacle and extending partially around an outer periphery of the plug hole, and a first locating recess and a second locating recess formed in the end of the receptacle and spaced at an angle of 90 degrees around the outer periphery of the plug hole;

b) an elongate swivel block including a hollow split plug tube extending upwardly from one end thereof, and a locating strip and a raised portion provided on the block adjacent the bottom of the split plug tube; and c) means for engaging the split plug tube within the plug hole of the mounting block to dispose the locating strip the locating groove and permit the raised portion to be selectively engageable within either the first or the second locating recess when the swivel block is disposed in either of two positions offset from each other by 90 degrees.

2. The swivel foot of claim 1 wherein the engaging means includes a headed bolt engageable within the split plug tube for pivotally securing the plug tube within the plug hole.

3. The swivel foot of claim 1 wherein the swivel block further includes an upwardly open chamber disposed adjacent the plug tube and a cover for closing the chamber.

4. The swivel foot of claim 3 wherein:

a) the chamber includes a pair of ribs provided on a pair of opposed interior walls of the chamber, and a stub tube extending vertically from a central bottom portion of the chamber; and b) the cover includes a downwardly extending pin receivable within the stub tube, a pair of opposed grooves for engaging the ribs, and a recessed portion disposable adjacent the receptacle and the plug tube for providing clearance to permit the swivel block to be pivoted relative to the mounting block.

* * * * *